US005890769A

United States Patent [19]

Fairbanks

[11] Patent Number: 5,890,769

[45] Date of Patent: Apr. 6, 1999

[54] CHILD RESTRAINING HARNESS

[76] Inventor: Juanita F. Fairbanks, 2101 Ocana Ave., Long Beach, Calif. 90815

[21] Appl. No.: 97,988

[22] Filed: Jun. 16, 1998

[51] Int. Cl.[6] ..... A47C 31/00

[52] U.S. Cl. ..... 297/467; 297/485; 297/DIG. 6

[58] Field of Search ..... 297/464, 467, 297/485, 468, 488, 219.12, 219.1, DIG. 6

[56] References Cited

U.S. PATENT DOCUMENTS

| | | | |
|---|---|---|---|
| 2,404,505 | 7/1946 | Knecht | 297/467 |
| 3,275,373 | 9/1966 | Card | 297/467 |
| 4,834,460 | 5/1989 | Herwig | 297/485 |
| 5,232,267 | 8/1993 | DeMatteo et al. | 297/467 |
| 5,299,855 | 4/1994 | Zubeck | 297/467 |
| 5,676,426 | 10/1997 | Herring | 297/485 |
| 5,713,630 | 2/1998 | Kralvik | 297/467 |

*Primary Examiner*—Peter M. Cuomo
*Assistant Examiner*—Anthony D. Barfield

[57] ABSTRACT

A new child restraining harness for restraining a child sitting on a chair. The inventive device includes an elongate flexible belt strap. A flexible crotch strap is coupled to the belt strap. Each of the ends of the belt strap is insertable into a loop space of a looped portion at the other end of the crotch strap. A pair of elongate flexible securing straps are coupled to the back region of the belt strap. A generally rectangular securing pad is provided for securing to a seat of a chair structure. The securing pad is detachably attachable to a bottom region of the crotch strap.

9 Claims, 2 Drawing Sheets

CHILD RESTRAINING HARNESS

BACKGROUND OF THE INVENTION

1. Field of the Invention

The present invention relates to child restraining harnesses and more particularly pertains to a new child restraining harness for restraining a child sitting on a chair.

2. Description of the Prior Art

The use of child restraining harnesses is known in the prior art. More specifically, child restraining harnesses heretofore devised and utilized are known to consist basically of familiar, expected and obvious structural configurations, notwithstanding the myriad of designs encompassed by the crowded prior art which have been developed for the fulfillment of countless objectives and requirements.

Known prior art child restraining harnesses include U.S. Pat. No. 5,056,869; U.S. Pat. No. 3,713,692; U.S. Pat. No. 4,867,464; U.S. Pat. No. 4,324,430; U.S. Pat. No. 3,185,521; and U.S. Pat. No. Des. 343,257.

While these devices fulfill their respective, particular objectives and requirements, the aforementioned patents do not disclose a new child restraining harness. The inventive device includes an elongate flexible belt strap. A flexible crotch strap is coupled to the belt strap. Each of the ends of the belt strap is insertable into a loop space of a looped portion at the other end of the crotch strap. A pair of elongate flexible securing straps are coupled to the back region of the belt strap. A generally rectangular securing pad is provided for securing to a seat of a chair structure. The securing pad is detachably attachable to a bottom region of the crotch strap.

In these respects, the child restraining harness according to the present invention substantially departs from the conventional concepts and designs of the prior art, and in so doing provides an apparatus primarily developed for the purpose of restraining a child sitting on a chair.

SUMMARY OF THE INVENTION

In view of the foregoing disadvantages inherent in the known types of child restraining harnesses now present in the prior art, the present invention provides a new child restraining harness construction wherein the same can be utilized for restraining a child sitting on a chair.

The general purpose of the present invention, which will be described subsequently in greater detail, is to provide a new child restraining harness apparatus and method which has many of the advantages of the child restraining harnesses mentioned heretofore and many novel features that result in a new child restraining harness which is not anticipated, rendered obvious, suggested, or even implied by any of the prior art child restraining harnesses, either alone or in any combination thereof.

To attain this, the present invention generally comprises an elongate flexible belt strap. A flexible crotch strap is coupled to the belt strap. Each of the ends of the belt strap is insertable into a loop space of a looped portion at the other end of the crotch strap. A pair of elongate flexible securing straps are coupled to the back region of the belt strap. A generally rectangular securing pad is provided for securing to a seat of a chair structure. The securing pad is detachably attachable to a bottom region of the crotch strap.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new child restraining harness apparatus and method which has many of the advantages of the child restraining harnesses mentioned heretofore and many novel features that result in a new child restraining harness which is not anticipated, rendered obvious, suggested, or even implied by any of the prior art child restraining harnesses, either alone or in any combination thereof.

It is another object of the present invention to provide a new child restraining harness which may be easily and efficiently manufactured and marketed.

It is a further object of the present invention to provide a new child restraining harness which is of a durable and reliable construction.

An even further object of the present invention is to provide a new child restraining harness which is susceptible of a low cost of manufacture with regard to both materials and labor, and which accordingly is then susceptible of low prices of sale to the consuming public, thereby making such child restraining harness economically available to the buying public.

Still yet another object of the present invention is to provide a new child restraining harness which provides in the apparatuses and methods of the prior art some of the advantages thereof, while simultaneously overcoming some of the disadvantages normally associated therewith.

Still another object of the present invention is to provide a new child restraining harness for restraining a child sitting on a chair.

Yet another object of the present invention is to provide a new child restraining harness which includes an elongate flexible belt strap. A flexible crotch strap is coupled to the belt strap. Each of the ends of the belt strap is insertable into a loop space of a looped portion at the other end of the crotch strap. A pair of elongate flexible securing straps are coupled to the back region of the belt strap. A generally rectangular securing pad is provided for securing to a seat of a chair structure. The securing pad is detachably attachable to a bottom region of the crotch strap.

Still yet another object of the present invention is to provide a new child restraining harness that helps keep a child from falling out of a chair, including high chairs and shopping cart child seats.

Even still another object of the present invention is to provide a new child restraining harness that allows an adult to quickly and easily remove the child wearing the harness from the chair the child is sitting on.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
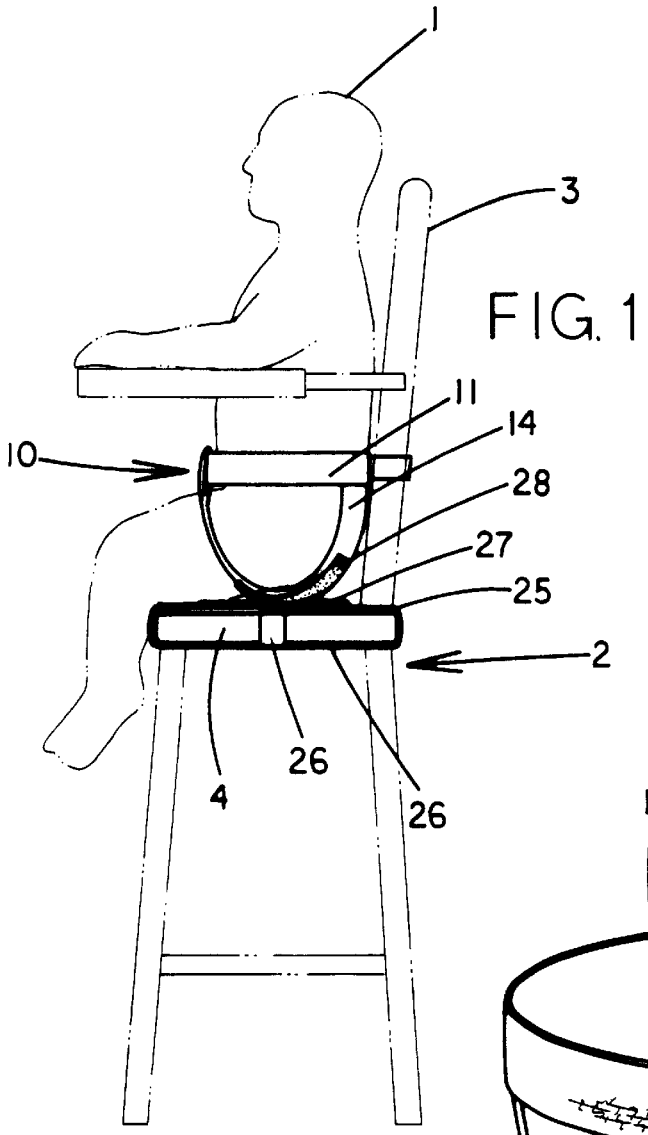
FIG. 1 is a schematic side view of a new child restraining harness in use according to the present invention.
Figure 2:
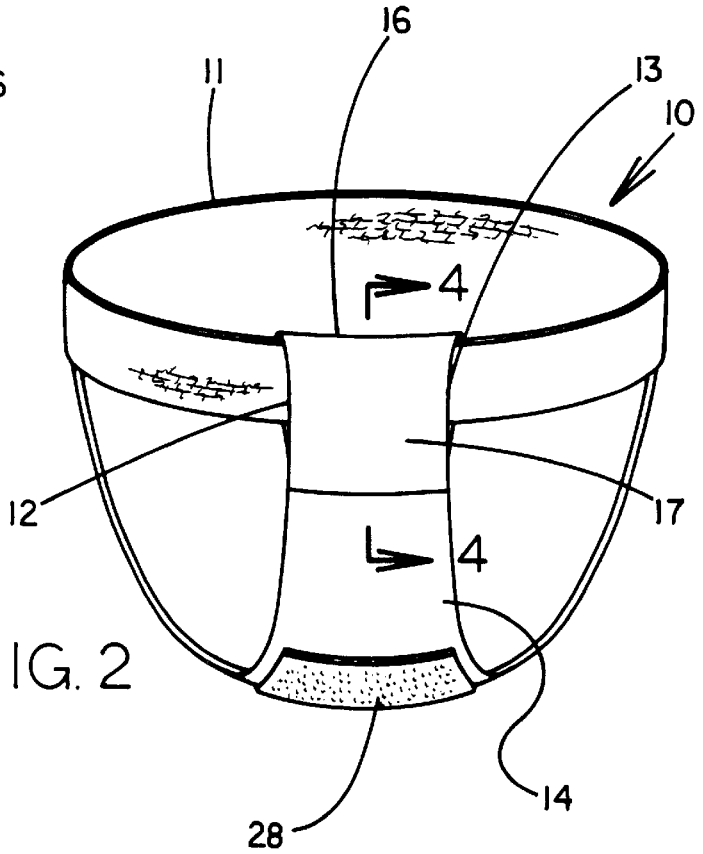
FIG. 2 is a schematic front perspective view of the present invention.
Figure 3:
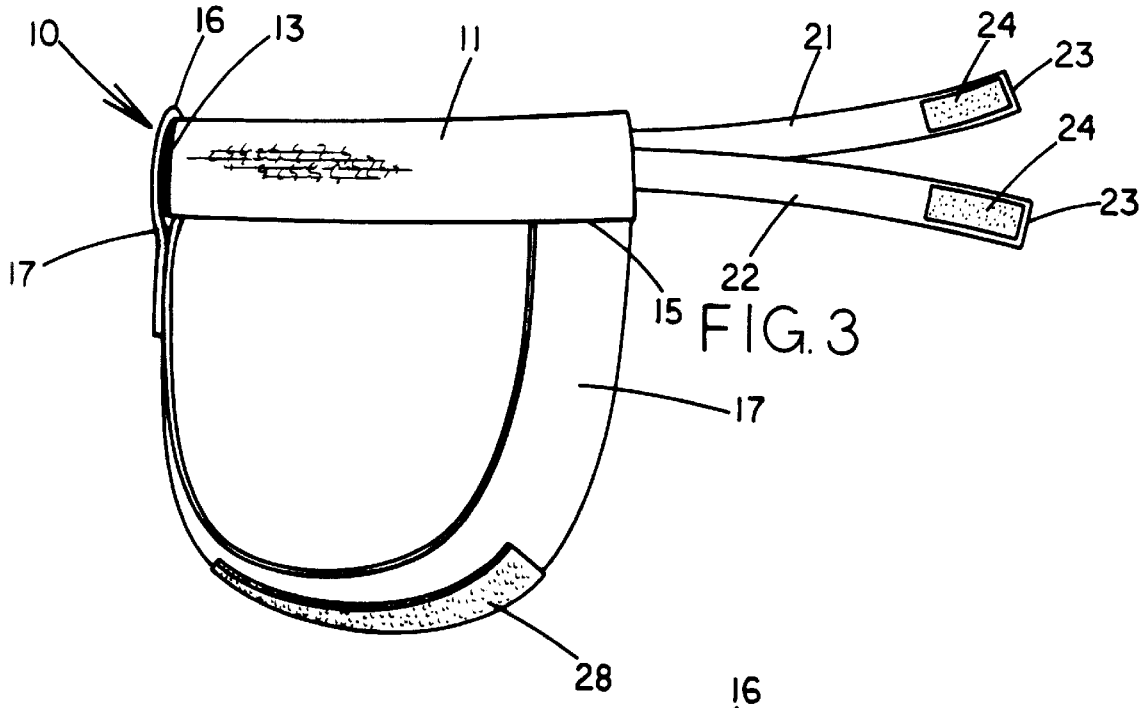
FIG. 3 is a schematic side view of the present invention.
Figure 4:
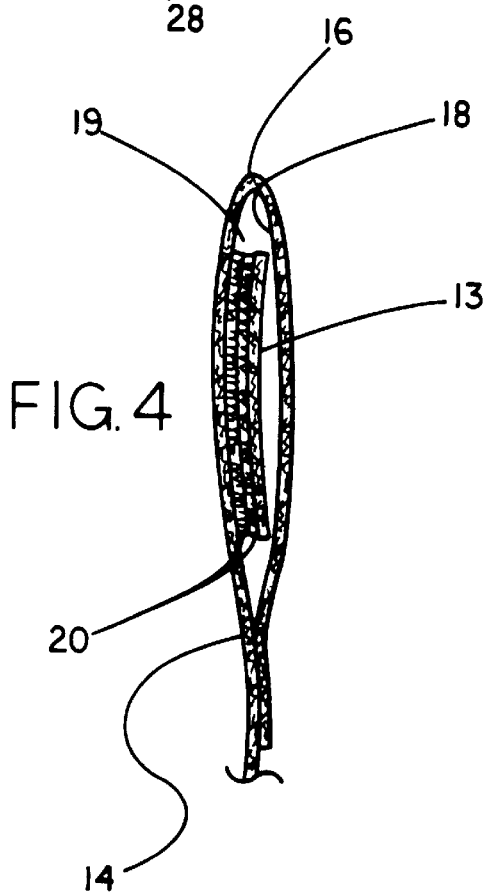
FIG. 4 is a schematic cross-sectional view of the present invention taken from line 4—4of FIG. 2.

With reference now to the drawings, and in particular to FIGS. 1 through 4 thereof, a new child restraining harness embodying the principles and concepts of the present invention and generally designated by the reference numeral 10 will be described.

As best illustrated in FIGS. 1 through 4, the child restraining harness 10 generally comprises an elongate flexible belt strap 11. A flexible crotch strap 14 is coupled to the belt strap 11. Each of the ends 12, 13 of the belt strap 11 is insertable into a loop space 19 of a looped portion 17 at the other end 16 of the crotch strap 14. A pair of elongate flexible securing straps 21,22 are coupled to the back region of the belt strap 11. A generally rectangular securing pad 25 is provided for securing to a seat 4 of a chair structure 2. The securing pad 25 is detachably attachable to a bottom region of the crotch strap 14.

Specifically, the elongate flexible belt strap 11 has a pair of opposite ends 12, 13. The belt strap 11 is designed for looping around the waist of a child 1. The flexible crotch strap 14 has first and second ends 15, 16. The first end 15 of the crotch strap 14 is coupled to the belt strap 11 at a back region between the ends 12,13 of the belt strap 11. The back region of the belt strap 11 is designed for positioning adjacent the back of the child 1 the belt strap 11 is looped around. The crotch strap 14 has a pair of elongate sides and has a width defined between the sides of the crotch strap 14. The sides of the crotch strap 14 converge together in a direction from the first end 15 of the crotch strap 14 towards the second end 16 of the crotch strap 14 such that the width of the crotch strap 14 tapers from the first end 15 of the crotch strap 14 towards the second end 16 of the crotch strap 14. The crotch strap 14 is designed for extending from the back of the child 1 underneath the crotch of the child 1 to the front of the child 1. The crotch strap 14 forms a pair of leg openings for extending the legs of the child 1 therethrough when the crotch strap 14 is extended underneath the crotch of the child 1.

The second end 16 of crotch strap 14 forms a looped portion 17. The looped portion 17 of the crotch strap 14 has an inner surface 18 defining a loop space 19 which has opposite side openings into the loop space 19. The looped portion 17 is designed for attaching the ends 12,13 of the belt strap 11 looped around the waist of the child 1 to the second end 16 of the crotch strap 14 extended under the crotch of the child 1 at the front of the waist of the child 1. Each of the ends 12,13 of the belt strap 11 is inserted into the loop space 19 of the looped portion 17 of the crotch strap 14. One of the ends of the belt strap is inserted through one of the side openings into the loop space while the other end of the belt strap is inserted through another of the side openings into the loop space. The ends 12,13 of the belt strap 11 are attached to the inner surface 18 of the looped portion 17 of the crotch strap 14, Ideally, a hook and loop fastener 20 detachably attaches the ends 12,13 of the belt strap 11 to the inner surface 18 of the looped portion 17. The hook and loop fastener 20 has a pair of complementary portions with one of the portions provided on the inner surface 18 of the looped portion 17 of the crotch strap 14 and the complementary portion provided on each of the ends 12,13 of the belt strap 11.

The pair of elongate flexible securing straps 21,22 are coupled to the back region of the belt strap 11. The securing straps 21, 22 are designed for looping around a back rest 3 of a chair structure 2 the child 1 is sitting on. The securing straps 21, 22 each have a free end 23 which are detachably attachable to each other when the securing straps 21, 22 are looped around the back rest 3 of the chair structure 2. Preferably, a hook and loop fastener 24 detachably attaches the free ends 23 of the securing straps 21, 22 together. Ideally, each of the free ends 23 of the securing strap has complementary portions of the hook and loop fastener provided thereon.

Ideally, the belt strap 11, the crotch strap 14 and the securing straps 21, 22 comprise a flexible nylon material.

The generally rectangular securing pad 25 is designed for resting on a seat 4 of a chair structure 2. The securing pad 25 has a plurality of elongate flexible attachment straps 26. The attachment straps 26 are designed for looping around the seat 4 of the chair structure 2 to secure the securing pad 25 to the seat 4 of the chair structure 2. In one preferred embodiment, the attachment straps 26 have hooks for attaching to the underside of the seat 4 of the chair structure 2. In another preferred embodiment, the attachment straps 26 have hook and loop fasteners for securing the ends of the attachment straps 26 together when looped underneath the seat 4 of the chair structure 2.

In use, the securing pad 25 is detachably attachable to a bottom region of the crotch strap 14 when the child 1 is seated on the seat 4 of the chair structure 2. Preferably, a hook and loop fastener 27, 28 detachably attached the securing pad 25 to the bottom region of the crotch strap 14. The securing pad 25 has a portion 27 of the hook and loop fastener provided thereon while the bottom region of the crotch strap 14 has another portion 28 of the hook and loop fastener provided thereon complementary to the portion provided on the securing pad 25.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A child restraining harness device, comprising:

an elongate flexible belt strap having a pair of opposite ends, said belt being for looping around the waist of a child;

a flexible crotch strap having first and second ends, said first end of said crotch strap being coupled to said belt strap at a back region between said ends of said belt strap;

said back region of said belt strap being for positioning adjacent the back of the child;

said second end of crotch strap having a looped portion, said looped portion of said crotch strap having an inner surface defining a loop space;

said crotch strap being for extending from the back of the child underneath the crotch of the child to the front of the child;

each of said ends of said belt strap being inserted into said loop space of said looped portion of said crotch strap;

a pair of elongate flexible securing straps being coupled to said back region of said belt strap, said securing straps being for looping around a back rest of a chair structure;

a generally rectangular securing pad for resting on a seat of a chair structure, said securing pad having a plurality of elongate flexible attachment straps, said attachment straps being for looping around the seat of the chair structure to secure said securing pad to the seat of the chair structure; and said securing pad being detachably attached to a bottom region of said crotch strap when the child is seated on the seat of the chair structure.

2. The child restraining harness device of claim 1, wherein said crotch strap has a pair of elongate sides, wherein said crotch strap has a width defined between said sides of said crotch strap, and wherein said sides of said crotch strap converge together in a direction from said first end of said crotch strap towards said second end of said crotch strap such that said width of said crotch strap tapers from said first end of said crotch strap towards said second end of said crotch strap.

3. The child restraining harness device of claim 1, wherein said loop space has opposite side openings into said loop space, one of said ends of said belt strap being inserted through one of said side openings into said loop space, and another of said ends of said belt strap being inserted through another of said side openings into said loop space.

4. The child restraining harness device of claim 1, wherein said ends of said belt strap are attached to said inner surface of said looped portion of said crotch strap.

5. The child restraining harness device of claim 4, wherein a hook and loop fastener detachably attaches said ends of said belt strap to said inner surface of said looped portion.

6. The child restraining harness device of claim 1, wherein said securing straps each have a free end, said free ends of said securing strap being detachably attachable to each other.

7. The child restraining harness device of claim 6, wherein a hook and loop fastener detachably attaches said free ends of said securing straps together.

8. The child restraining harness device of claim 1, wherein a hook and loop fastener detachably attached said securing pad to said bottom region of said crotch strap.

9. A child restraining harness device, comprising:

an elongate flexible belt strap having a pair of opposite ends, said belt being for looping around the waist of a child;

a flexible crotch strap having first and second ends, said first end of said crotch strap being coupled to said belt strap at a back region between said ends of said belt strap;

said back region of said belt strap being for positioning adjacent the back of the child;

said crotch strap having a pair of elongate sides, said crotch strap having a width defined between said sides of said crotch strap;

said sides of said crotch strap converging together in a direction from said first end of said crotch strap towards said second end of said crotch strap such that said width of said crotch strap tapers from said first end of said crotch strap towards said second end of said crotch strap;

said second end of crotch strap having a looped portion, said looped portion of said crotch strap having an inner surface defining a loop space, said loop space having opposite side openings into said loop space;

said crotch strap being for extending from the back of the child underneath the crotch of the child to the front of the child;

each of said ends of said belt strap being inserted into said loop space of said looped portion of said crotch strap, one of said ends of said belt strap being inserted through one of said side openings into said loop space, another of said ends of said belt strap being inserted through another of said side openings into said loop space;

said ends of said belt strap being attached to said inner surface of said looped portion of said crotch strap, wherein a hook and loop fastener detachably attaches said ends of said belt strap to said inner surface of said looped portion;

a pair of elongate flexible securing straps being coupled to said back region of said belt strap, said securing straps being for looping around a back rest of a chair structure, said securing straps each having a free end, said free ends of said securing strap being detachably attachable to each other, wherein a hook and loop fastener detachably attaches said free ends of said securing straps together;

a generally rectangular securing pad for resting on a seat of a chair structure, said securing pad having a plurality of elongate flexible attachment straps, said attachment straps being for looping around the seat of the chair structure to secure said securing pad to the seat of the chair structure; and said securing pad being detachably attachable to a bottom region of said crotch strap when the child is seated on the seat of the chair structure, wherein a hook and loop fastener detachably attaches said securing pad to said bottom region of said crotch strap.

* * * * *